US007162900B1

(12) United States Patent
Lu

(10) Patent No.: US 7,162,900 B1
(45) Date of Patent: Jan. 16, 2007

(54) TUBULAR LOCK AND MASTER KEY

(75) Inventor: Francisco Lu, Kaohsiung (TW)

(73) Assignee: Miz Engineering Ltd. (TW)

( * ) Notice: Subject to any disclaimer, the term of this patent is extended or adjusted under 35 U.S.C. 154(b) by 0 days.

(21) Appl. No.: 11/216,357

(22) Filed: Aug. 31, 2005

(51) Int. Cl.
*E05B 19/12* (2006.01)
*E05B 27/08* (2006.01)

(52) U.S. Cl. ..... 70/491; 70/398; 70/404

(58) Field of Classification Search ..... 70/491, 70/408, 403, 404, 337–343, 409, 395, 394, 70/411, 398, 407, 376, 377, 392
See application file for complete search history.

(56) References Cited

U.S. PATENT DOCUMENTS 1,036,764 A * 8/1912 Wilson ..... 70/491
1,173,677 A * 2/1916 Muller ..... 70/493
1,851,986 A * 4/1932 Rubsamen ..... 70/491
2,090,114 A * 8/1937 Deutsch ..... 70/411
3,102,412 A * 9/1963 Christopher ..... 70/491
3,142,167 A * 7/1964 Christopher ..... 70/411
3,204,437 A * 9/1965 Dreyfus ..... 70/350
3,380,268 A * 4/1968 Perrill ..... 70/491
3,961,506 A * 6/1976 Perez ..... 70/491
4,622,834 A * 11/1986 Hughes ..... 70/395
4,683,739 A * 8/1987 Hughes ..... 70/365
4,831,852 A * 5/1989 Hughes ..... 70/491
5,174,140 A * 12/1992 Lee ..... 70/491

* cited by examiner

*Primary Examiner*—Lloyd A. Gall
(74) *Attorney, Agent, or Firm*—Ostrolenk Faber Gerb & Soffen, LLP

(57) ABSTRACT

A master key includes a key base having a key handle, a fixing seat and a sleeve, all of which are connected to each other integrally. The fixing seat has a plurality of angularly spaced apart spring holes having respective key springs. A key tube includes a large cross-section tube section inserted into the sleeve, and a small cross-section tube section fixed to the fixing seat. The large tube section includes a plurality of angularly spaced apart long and short grooves. The long grooves are aligned with the respective spring holes to receive slide pieces, and the short grooves have respective shoulder faces. A tubular lock to be used with the master key is also disclosed.

16 Claims, 5 Drawing Sheets

TUBULAR LOCK AND MASTER KEY

BACKGROUND OF THE INVENTION

1. Field of the Invention

This invention relates to improvements relating to a tubular lock and a master key, 2. Description of the Related Art Tubular locks have been used commonly in places, such as recreational and amusement centers, where a large number of similar pieces of equipment, e.g., amusement and game machines, are provided. Management of such a large number of machines in such places is difficult and troublesome. Generally, the machines are provided with respective tubular locks, and respective keys for the tubular locks are kept in a bundle and managed by an operator. When one of the machines requires unlocking, the operator in charge of the keys must select the right key from the bundle of keys according to an item number provided on the particular machine to be opened. However, if one of the keys has been misplaced or removed from the key bundle and not returned, the corresponding machine cannot be opened. In order to facilitate management of such keys, there is suggested a master key which can be used to open a plurality of similar or identical machines provided within a particular area.

Referring to FIG. 1, a conventional master key 1 includes a key base 11, a key tube 12, seven slide pieces 13 (only one is shown), seven key springs 14 (only one is shown), a sleeve 15, an elastic member 16 and a screw 17.

The key base 11 has a front end which is recessed to form a receiving space ill and seven spring slots 112 around the receiving space 111. The key tube 12 is inserted into the receiving space 111, and includes a central hole 122 defined by a tubular wall 121 and seven grooves 123 formed on an outer surface of the tubular wall 121.

Each slide piece 13 is placed slidably within one of the grooves 123, and each key spring 14 is inserted into one of the spring slots 112 to abut against the corresponding slide piece 13. The sleeve 15 is sleeved on the key tube 12 to retain the slide pieces 13 in the respective grooves 123. The elastic element 16 is sleeved on the key tube to bias the sleeve 15. The screw 17 is used to fasten the key tube 12 to the key base 11.

Referring to FIG. 2, a conventional tubular lock 2 includes a lock housing 21, a rotatable core body 22, a fixed body 23, and several sets of outer and inner tumblers 24, 25 and tumbler springs 26.

The lock housing 21 includes a key hole 211 for insertion of the key 1. The core body 22 is disposed inside the lock housing 21 and includes a plurality of first tumbler holes 221. The fixed body 23 is fixed within the lock housing 21 and has a plurality of second tumbler holes 231 in alignment with the first tumbler holes 221. The second tumbler holes 231 are formed as blind holes with equal depth.

The outer tumblers 24 are different in length, whereas the inner tumblers 25 have an equal length which is the same as the depth of the second tumbler holes 231. Each tumbler spring 26 biases one of the inner tumblers 25. Before the master key 1 is inserted into the tubular lock 2, the outer and inner tumblers 24, 25 are biased by the respective tumbler springs 26 to move toward the key hole 211 so that each inner tumbler pin 25 projects out of the lock seat 23 and into the core body 22.

Referring to FIG. 3, when the master key 1 is inserted into the tubular lock 2, since the spring force of each key spring 14 is larger than that of the tumbler springs 26, each slide piece 13 pushes the outer and inner tumblers 24, 25 until the inner tumblers 25 contact the bottoms of the respective second tumbler holes 231. With the continued insertion of the master key 1, as the outer and inner tumblers 24, 25 cannot move further, the slide pieces 13 are pushed backward until the front end of the key tube 12 presses the core body 22. At this time, the juncture between the outer and inner tumblers 24, 25 coincides with the juncture between the core body 22 and the fixed body 23 so that the core body 22 is released and becomes rotatable.

However, the aforesaid tubular lock 2 and the master key 1 encounter the following problems:

1. Assembly is inconvenient due to a large number of components used in the master key 1. In particular, since the sleeve 15 and the key base 11 are separate components, assembly must be done by attaching the sleeve 15 and the elastic element 16 to the key tube 12 after the slide pieces 13 are put into the respective grooves 123, and by aligning carefully the slide pieces 13 with the respective key springs 14 in order to insert the slide pieces 13 into the respective spring slots 112. Assembly as such is complicated, increases costs, and consumes time and labor.

2. All of the inner tumbler pins 25 must be equal in length in order to ensure that they do not protrude from the fixed body 23 when they are pressed to reach the bottoms of the respective second tumbler holes 231 in order to permit rotation of the core body 22. However, it is easy for a burglar to pick the tubular lock 2 by inserting and pushing seven pins into the first tumbler holes 221, respectively. Therefore, the tubular lock 2 and the master key 1 do not provide a sufficient anti-burglar effect.

SUMMARY OF THE INVENTION

An object of the present invention is to provide an improved master key for a tubular lock, which is easy for assembly and which can provide a sufficient anti-burglar effect.

Another object of the present invention is to provide an improved tubular lock for coordination with the improved master key according to the present invention.

According to one aspect of the present invention, a master key comprises a key base, a key tube, and a plurality of slide pieces and key springs. The key base includes a key handle, a fixing seat connected to the key handle, and a sleeve connected to the fixing seat. The fixing seat has a plurality of angularly spaced apart spring holes. The sleeve has a sleeve wall projecting from the fixing seat in a direction away from the key handle.

The key tube includes a large cross-section tube section, and a small cross-section tube section. The small cross-section tube section is fixed to the fixing seat and surrounded by the spring holes. The large cross-section tube section is inserted into the sleeve. The large cross-section tube section includes a front end opposite to the small cross-section tube section, and a plurality of long and short grooves that are spaced apart angularly on an outer surface of the large cross-section tube section and that extend from the front end toward the small cross-section tube section. The long grooves are aligned with the spring holes, respectively. The short grooves define respective shoulder faces facing the front end of the large cross-section tube section.

The key springs are disposed respectively within the spring holes. The slide pieces are disposed respectively and slidably within the long grooves and biased by the key springs.

According to another aspect of the present invention, a tubular lock includes a lock housing having a key hole; a core body disposed rotatably within the lock housing proximate to the key hole and including a plurality of first and second tumbler holes which are spaced apart from each other angularly; and a fixed body fixed within the lock housing and adjacent to the core body. The fixed body includes a plurality of third tumbler holes which are spaced apart angularly from each other and which are aligned with the first and second tumbler holes, respectively. A plurality of first and second tumblers are further provided. The first tumblers are inserted respectively into the first tumbler holes. The second tumblers are inserted respectively into the second tumbler holes. The first tumblers each has an outer tumbler section proximate to the key hole, an inner tumbler section distal from the key hole, and a stop member formed between the outer and inner tumbler sections for limiting inward movement of said outer and inner tumbler sections by a predetermined distance. The inner tumbler sections of the first tumblers have the same length. A plurality of third tumblers are respectively disposed within the third tumbler holes. A plurality of tumbler springs are respectively disposed within the third tumbler holes to bias the third tumblers, respectively.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
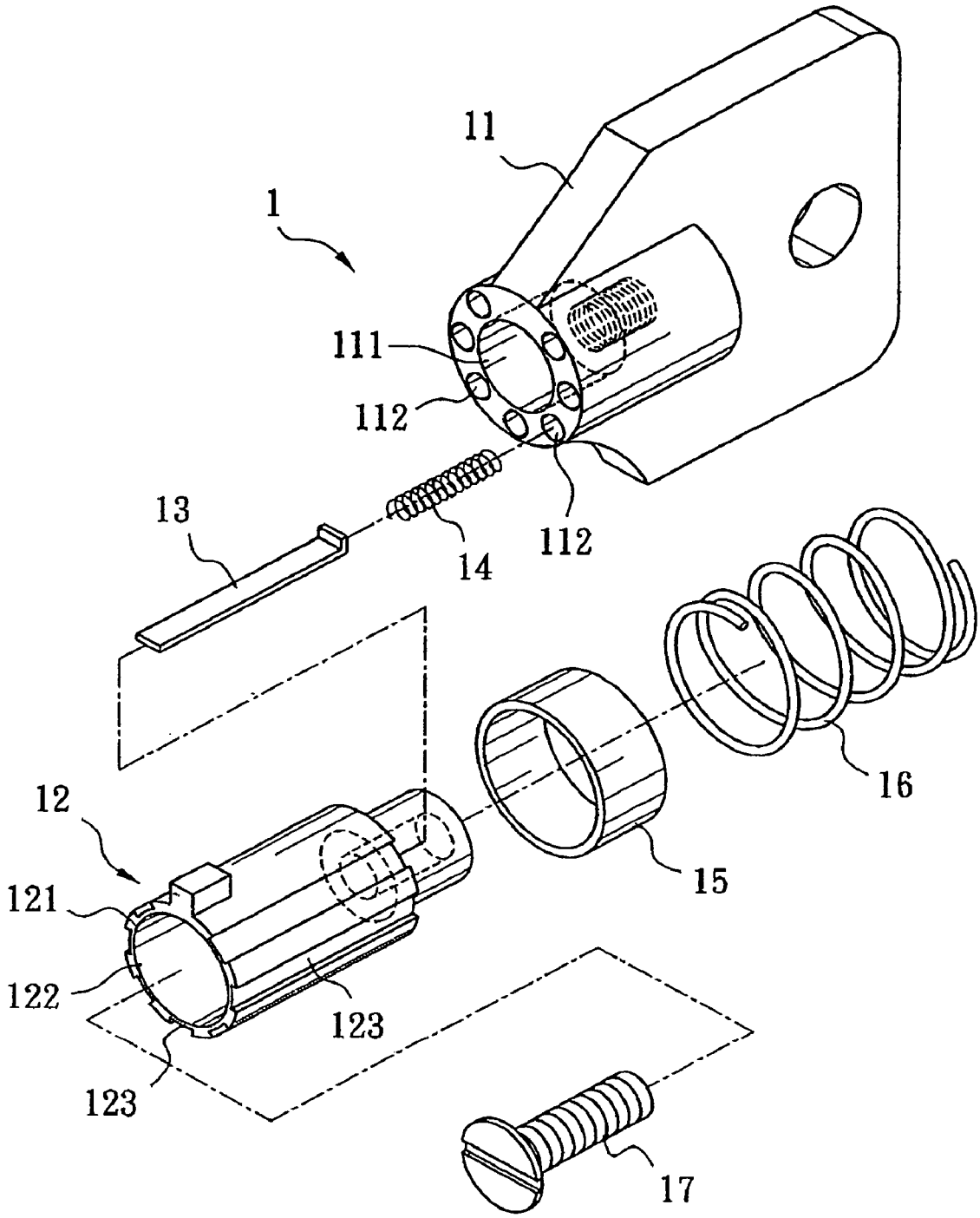
FIG. 1 PRIOR ART
FIG. 1 is an exploded view of a conventional master key.
Figure 2:
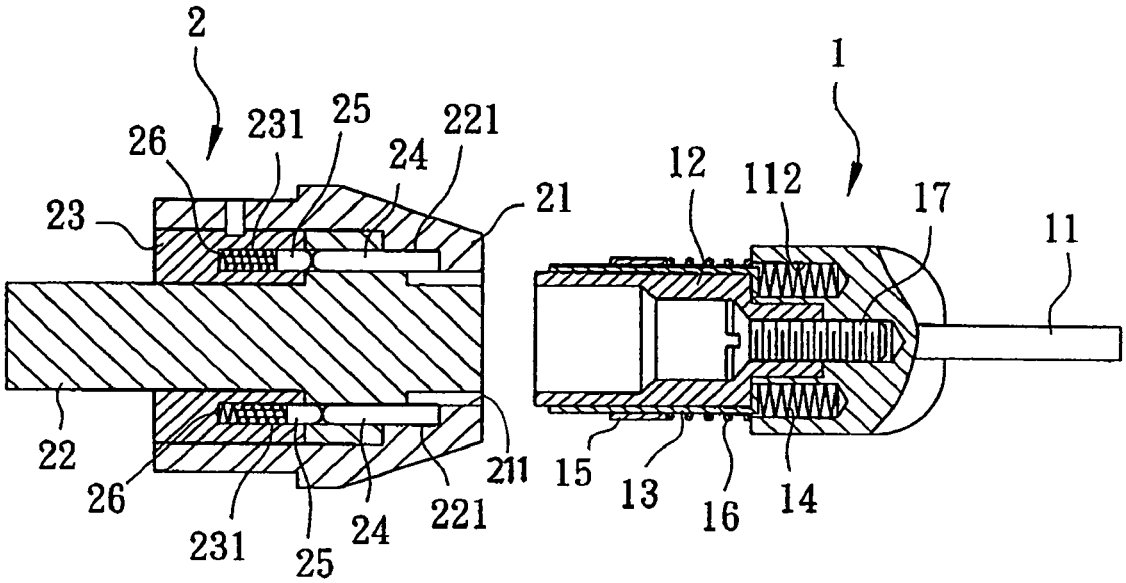
FIG. 2 PRIOR ART
FIG. 2 is a sectional view of the master key of FIG. 1 in combination with a tubular lock.
Figure 3:
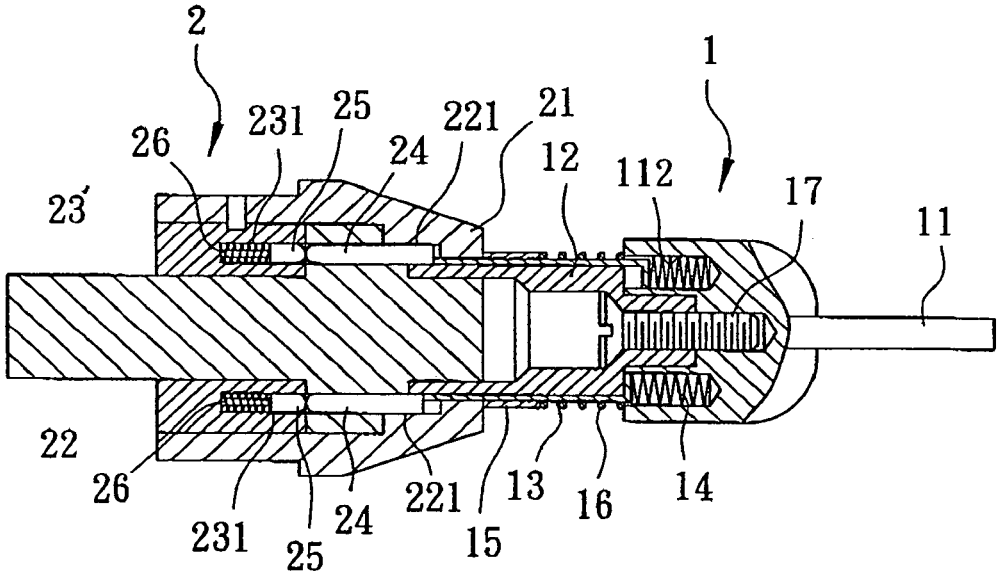
FIG. 3 PRIOR ART
FIG. 3 is the same view as FIG. 2, but having the master key inserted into the tubular lock.

Before the present invention is described in greater detail, it should be noted that same reference numerals have been used to denote like elements throughout the specification.

Figure 4:
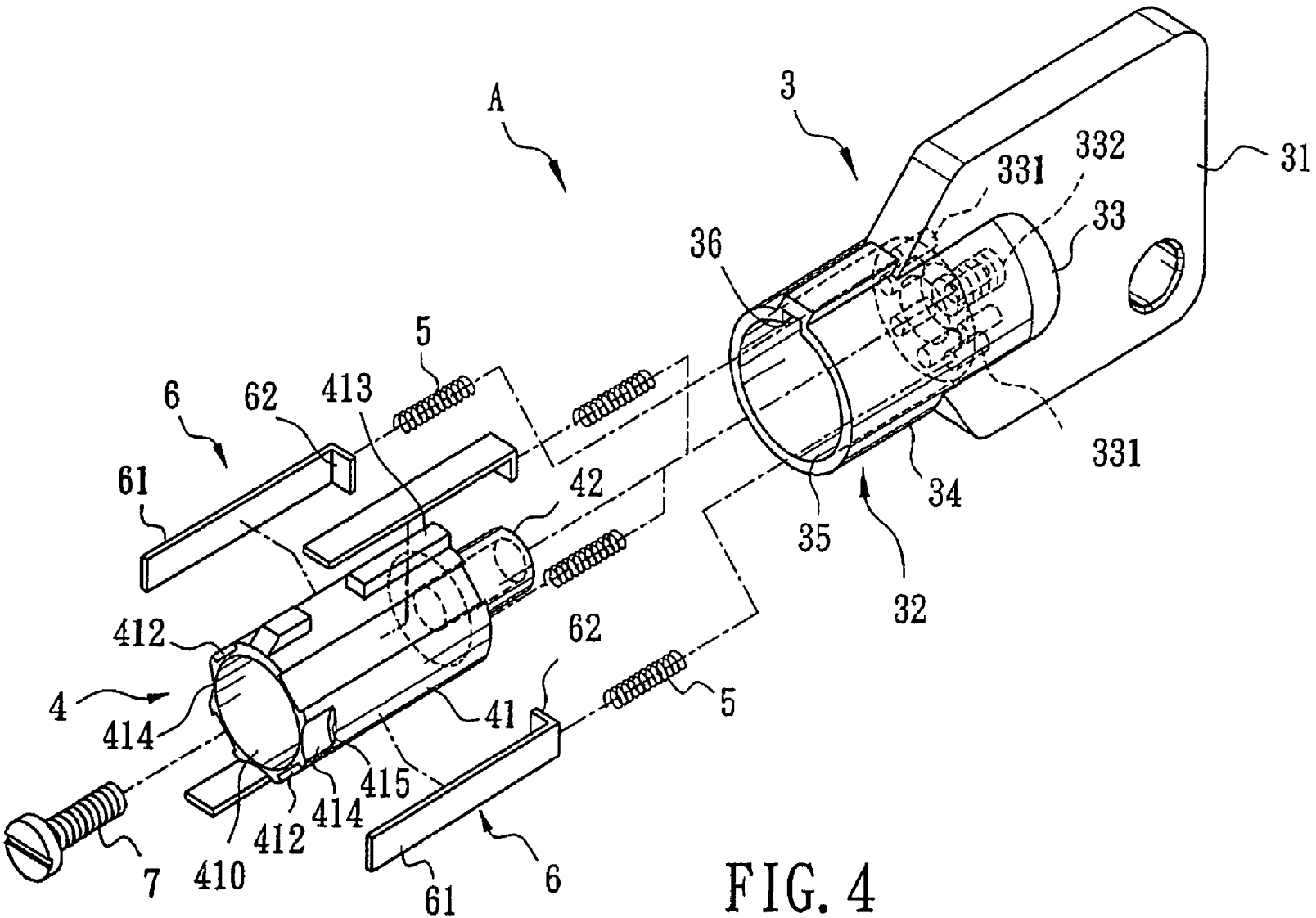
FIG. 4 is an exploded view of a master key embodying the present invention.

Referring to FIG. 4, a master key (A) according to a preferred embodiment of the present invention includes a key base 3, a key tube 4, four key springs 5, four slide pieces 6 and a fastening screw 7.

The key base 3 includes a flat key handle 31, a fixing seat 33 connected to the key handle 31, and a sleeve 32 connected to the fixing seat 33. The sleeve 32 includes a sleeve wall 34 extending from a peripheral end of the fixing seat 33 in a direction away from the key handle 31. The fixing seat 33 and the sleeve wall 34 defines a receiving space 35.

The fixing seat 33 is formed with a plurality of angularly spaced-apart spring holes 331 which are communicated with the receiving space 35, and a fastening hole 332 surrounded by the spring holes 331. An alignment groove 36 is formed in an inner side of the sleeve wall 34 in communication with the receiving space 35.

Preferably, the key base 3 is formed as a one-piece component so that the key handle 31 is integral with the fixing seat 33 and the sleeve 34. While seven spring holes 331 are formed in the fixing seat 33, only four of the seven spring holes 331 are used in this embodiment to receive respectively four slide pieces 6 which will be described hereinafter. In other words, the key base 3 is designed to accommodate different numbers of slide pieces 6, for instance, two, three, five or six slide pieces 6. Of course, the number of the spring holes 331 may be greater than seven, or less than seven.

The key tube 4 includes a large cross-section tube section 41 inserted into the receiving space 35 of the sleeve wall 34, and a small cross-section tube section 42 inserted into the fixing seat 33. The large cross-section tube section 41 has a front end 410 opposite to the small cross-section tube section 42. Four long grooves 412 and three short grooves 414 are formed on an outer surface of the large cross-section tube section 41 in an angularly spaced-apart relationship. The long and short grooves 412, 414 are aligned axially and respectively with the spring holes 331 of the fixing seat 33. Each of the long and short grooves 412, 414 extends from the front end 410 of the large cross-section tube section 41 toward the small cross-section tube section 42. Each short groove 414 is provided between a pair of the long grooves 412, and defines a shoulder face 415 facing the front end 410. The lengths of the short grooves 414 measured from the front end 410 are shorter than the length of the long grooves 412. An alignment key 413 extends axially of the key tube 4 and projects radially and outwardly from the outer surface of the large cross-section tube section 41. The alignment key 413 is insertable into the alignment groove 36 of the sleeve 32.

In this embodiment, two of the three short grooves 414 are provided with different lengths so that the shoulder faces 415 have different distances from the front end 410. Alternatively, all of the three short grooves 414 may be provided with different lengths.

Four key springs 5 are disposed respectively in the spring holes 331. All of the key springs 5 are compression springs in this embodiment.

Each slide piece 6 includes an elongated slide plate 61 received slidably in one of the long grooves 412. A right-angled bent portion 62 is formed at one end of each slide plate 61 adjacent to one of the key springs 5 so that the slide piece 6 is biased by the corresponding key spring 5.

The fastening screw 7 extends through the small cross-section tube section 42 and is engaged threadedly with the fastening hole 332 of the fixing seat 33, thereby securing the key tube 4 to the fixing seat 33. While the key tube 4 is secured to the fixing seat 33 using the fastening screw 7 in this embodiment, the securing of the key tube 4 may be accomplished by using any other suitable means or method according to the present invention.

In assembly, the key springs 5 are inserted into the respective spring holes 331, and the slide pieces 6 are put into the respective slide grooves 412. Since the sleeve 32 is provided with the alignment groove 36, once the alignment key 413 is aligned with the alignment groove 36, the key tube 4 together with the slide pieces 6 can be inserted properly into the sleeve 32, and at the same time the slide pieces 6 can be aligned accurately with the respective key springs 5. Finally, the key tube 4 is fastened to the fixing seat 33 using the fastening screw 7. It should be noted that the slide pieces 6 do not extend into the respective spring holes 331; instead, the key springs 5 extend out of the respective spring holes 331. Therefore, the master key (A) according to the present invention does not require careful attention in aligning each slide piece 6 with the corresponding spring hole 332 before the key tube 4 is fastened to the fixing seat 33, unlike the conventional master key 1.

Figure 5:
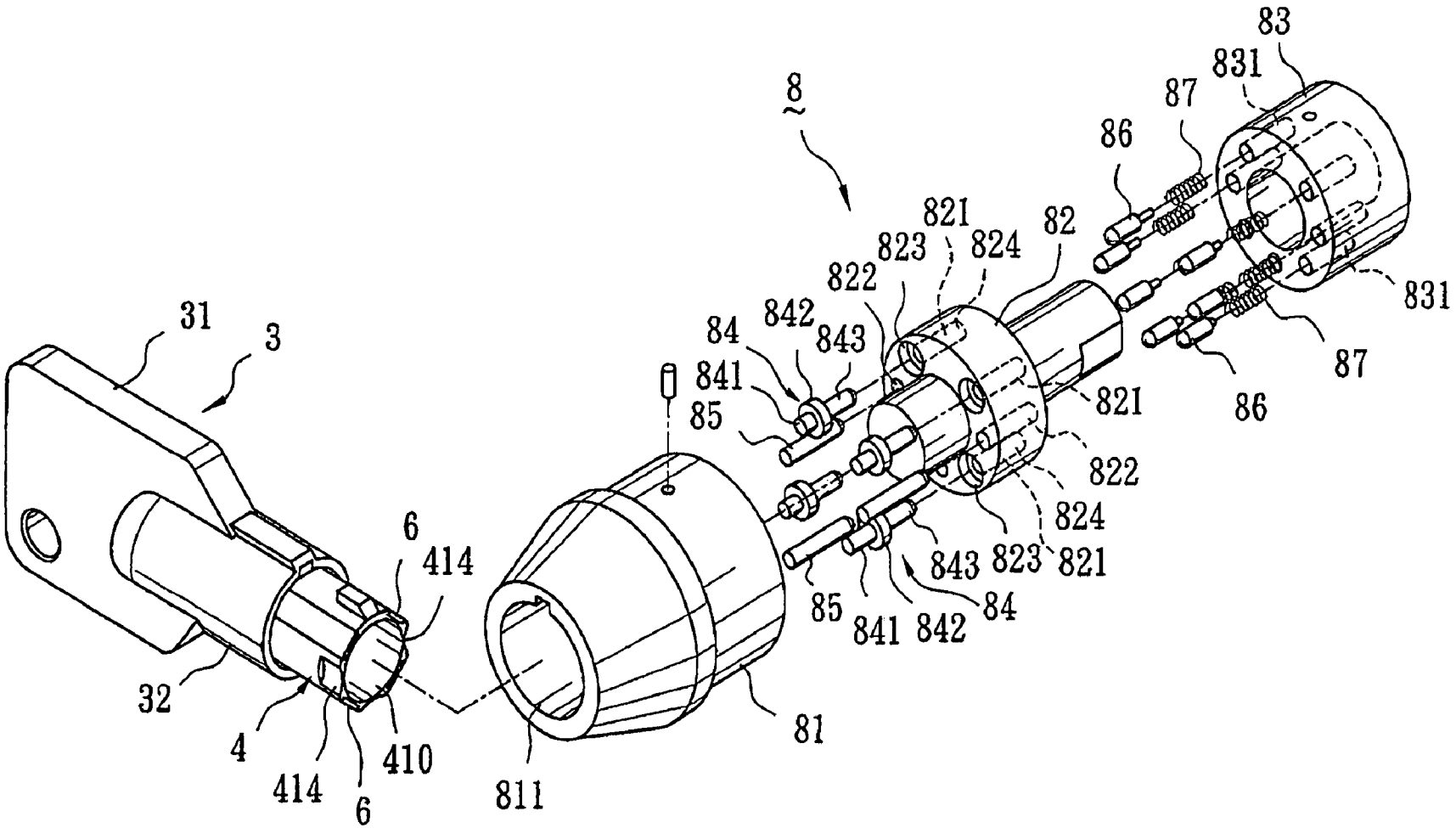
FIG. 5 is an exploded view of a tubular lock embodying the present invention.

Referring to FIG. 5, there is shown a tubular lock 8 which embodies the present invention and which is to be used in combination with the master key (A). The tubular lock 8 includes a lock housing 81, a core body 82, a fixed body 83, four first tumblers 84, three second tumblers 85, seven third tumblers 86, and seven tumbler springs 87.

The lock housing 81 includes a key hole 811 for insertion of the master key (A). The core body 82 is inserted into the lock housing 81 and is disposed proximate to the key hole 811 so that it can be actuated and rotated by the master key (A) for operating an opening/closing device (not shown). The core body 82 includes four first tumbler holes 821 which are spaced apart angularly, and three second tumbler holes 822 each of which is disposed between two adjacent ones of the first tumbler holes 821. Thus, the first tumbler holes 821 alternate with the second tumbler holes 822. Each first tumbler hole 821 has an enlarged outer section 823 proximate to the key hole 811, and an inner section 824 connected to the outer section 823 and having a cross-section smaller than that of the outer section 823. Each second tumbler hole 822 has a substantially constant cross-section. While the first and second tumbler holes 821 and 822 are disposed alternately in this embodiment, the present invention should not be limited thereto. The first and second tumbler holes 821, 822 may be in any other suitable arrangement.

The fixed body 83 is fixed within the lock housing 81 around a rear portion of the core body 82, and includes seven third tumbler holes 831 which are aligned and communicated with the first and second tumbler holes 821, 822, respectively.

The first tumblers 84 are disposed respectively and slidably within the first tumbler holes 821. Each first tumbler 84 includes an outer tumbler section 841, an inner tumbler section 843, and a stop member 842 disposed between the outer and inner tumbler sections 841, 843 to limit the inward movement of the outer and inner tumbler sections 841, 843 to by predetermined distance. The outer tumbler sections 841 of at least two first tumblers 84 have different lengths. The inner tumbler section 843 of each first tumbler 84 is slidable inward within the inner section 824 of one of the first tumbler holes 821 until the stop member 842 contacts a shoulder 825 (FIG. 6) between the enlarged outer section 823 and the inner section 824 of the corresponding first tumbler hole 821. In this embodiment, the outer tumbler sections 841 of all of the four first tumblers 84 are provided with different lengths.

As stated above, each first tumbler 84 is stopped by the stop member 842 from moving further inward. However, the stop member 842 is not absolutely necessary in the present invention. Each first tumbler 84 may be stopped from moving further if the outer tumbler section 841 is provided with a diameter larger than that of the corresponding first tumbler hole 821. In this case, the enlarged outer sections 823 are not necessary in the first tumbler holes 821.

The second tumblers 85 are disposed slidably and respectively within the second tumbler holes 822. The third tumblers 86 are disposed respectively within the third tumbler holes 831. Further, the tumbler springs 87 are disposed respectively within the third tumbler holes 831 to bias the respective third tumblers 86 to push the corresponding first and second tumblers 84, 85.

Figure 6:
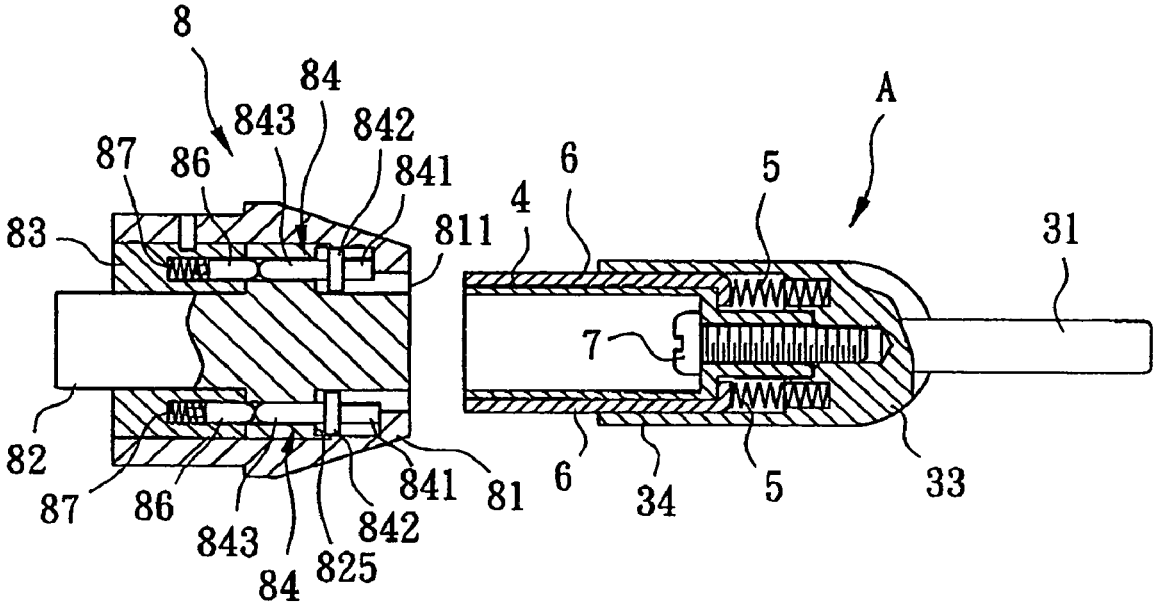
FIG. 6 is a sectional view of the master key of FIG. 4 and the tubular lock of FIG. 5.
Figure 7:
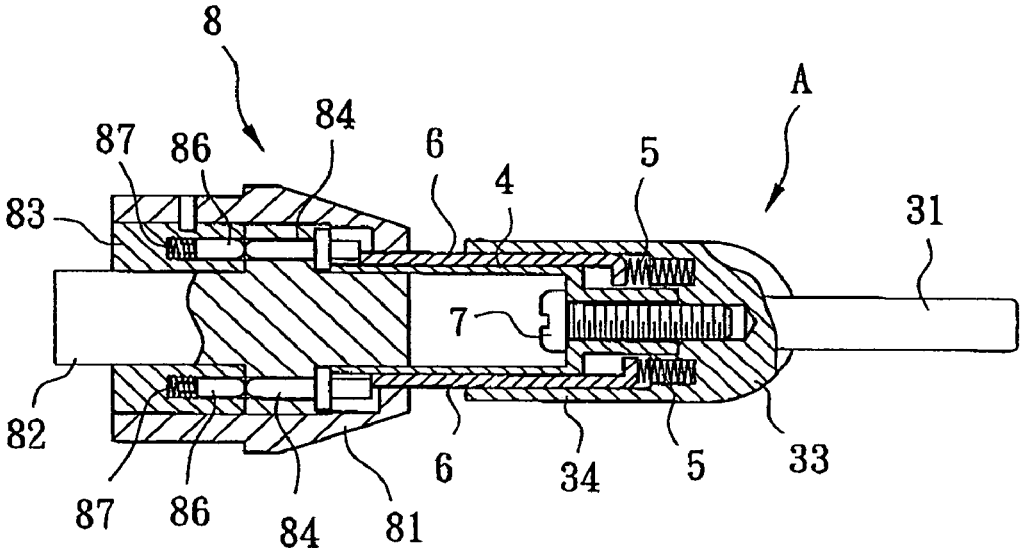
FIG. 7 is the same view as FIG. 6, but with the master key inserted into the tubular lock.

Referring to FIGS. 6 and 7, before the master key (A) is inserted into the tubular lock 8, the third tumblers 86 are biased by the tumbler springs 87 toward the key hole 811 so that the third tumblers 86 protrude partially from the fixed body 83 and extend into the core body 82. In this state, the core body 82 is restricted from rotation.

When the master key (A) is inserted into the tubular lock 8, the slide pieces 6 of the master key (A) push the first tumblers 84, and the shoulder faces 415 (FIG. 4) of the short grooves 414 push the corresponding second tumblers 85. Since the spring force of the key springs 5 is greater than that of the tumbler springs 87, the slide pieces 6 push the corresponding first tumblers 84 until the stop members or flanges 842 of the first tumblers 84 abut against the shoulders 825 of the respective enlarged outer sections 823 of the first tumbler holes 821 and stop. However, the shoulder faces 415 of the short grooves 414 in the master key (A) continue to push the corresponding second tumblers 85.

At this time, the continued movement of the master key (A) causes each slide piece 6 to move backward, and the shoulder faces 415 continues to push the second tumblers 85 until the front end 410 of the key tube 4 contacts the core body 82. As a result, the contact points of the first and third tumblers 84, 86 and the contact points of the second and third tumblers 85, 86 coincide with the contact surfaces of the core body 82 and the fixed body 83, thereby releasing the core body 82 from the third tumblers 86.

It should be noted that, since it is unnecessary to push the third tumblers 86 to abut against the bottoms of the respective third tumbler holes 831 in the present invention, the third tumblers 86 need not be equal in length, thereby increasing difficulties for a burglar to pick the tubular lock 8.

Since the master key (A) includes the sleeve 32 connected to or integrally formed with the key handle 31 for retaining the slide pieces 6, the number of component parts to be assembled in the master key (A) is reduced compared to the conventional master key in which the slide pieces 13 are retained on the key tube 12 through the separate sleeve 15 and the elastic member 16. In addition, because of the presence of the alignment key 413 and the alignment groove 36 in the present invention, the slide pieces 6 can be aligned easily with the spring holes 331 and the key springs 5 by merely aligning the alignment key 413 with the alignment groove 36. Thus, assembly of the master key (A) is easy and convenient compared to the conventional master key 1.

As mentioned hereinbefore, the conventional tubular lock 2 has seven inner tumblers 25 that are equal in length and thus can be easily picked by a burglar using seven pins to push the outer tumblers 24 until the inner tumblers 25 contact the bottoms of the respective tumbler holes 231. Unlike the conventional tubular lock 2, the tubular lock 8 according to the present invention is provided with the third tumblers 86 having different lengths, particularly, the third tumblers 86 which are aligned with two second tumblers 85 having different lengths. Thus, it is difficult for a burglar to successfully pick the tubular lock 8 by inserting seven pins to push the first and second tumblers 84, 85. In particular, if the first and second outer tumblers 84, 85 were to be pushed inward using seven pins, the three second tumblers 85 would project into the fixed body 83 from the core body 82 so that the tubular lock 8 cannot be unlocked. Therefore, the tubular lock 8 provides an effective protection against burglars.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A master key comprising:

a key base including a key handle, a fixing seat connected to said key handle, and a sleeve connected to said fixing seat, said fixing seat having a plurality of angularly spaced apart spring holes, said sleeve having a sleeve wall projecting from said fixing seat in a direction away from said key handle;

a key tube including a large cross-section tube section, and a small cross-section tube section, said small cross-section tube section being fixed to said fixing seat and surrounded by said spring holes, said large cross-section tube section being inserted into said sleeve, said large cross-section tube section including a front end opposite to said small cross-section tube section, and a plurality of long and short grooves that are spaced apart angularly on an outer surface of said large cross-section tube section and that extend from said front end toward said small cross-section tube section, said long grooves being aligned with said spring holes, respectively, said short grooves respectively defining shoulder faces facing said front end of said large cross-section tube section;

a plurality of key springs disposed respectively within said spring holes; and a plurality of slide pieces disposed respectively and slidably within said long grooves and biased by said springs.

2. The master key of claim 1, further comprising aligning elements provided on said sleeve wall and said large cross-section tube section, respectively, for aligning said key tube with said sleeve.

3. The master key of claim 2, wherein said aligning elements include an alignment key projecting radially and axially from said outer surface of said large cross-section tube section, and an alignment groove formed in said sleeve wall to receive said alignment key.

4. The master key of claim 3, wherein said key handle, said fixing seat, and said sleeve are formed integrally as one piece.

5. The master key of claim 1, wherein said long grooves alternate with said short grooves.

6. The master key of claim 4, wherein at least two of said short grooves have different lengths which are measured from said front end.

7. The master key of claim 1, wherein each of said slide pieces has a slide plate slidable within a corresponding one of said long grooves, and a bent portion extending from said slide plate to be in abutment with a corresponding one of said key springs.

8. The master key of claim 1, further comprising a fastening screw extending through and fastening said small cross-section tube section to said fixing seat.

9. The master key of claim 1, wherein each of said key springs projects outwardly of one of said spring holes.

10. A tubular lock comprising:

a lock housing having a key hole;

a core body disposed rotatably within said lock housing proximate to said key hole and including a plurality of first and second tumbler holes which are spaced apart from each other angularly;

a fixed body fixed within said lock housing and adjacent to said core body, said fixed body including a plurality of third tumbler holes which are spaced apart angularly from each other and which are aligned with said first and second tumbler holes, respectively;

a plurality of first and second tumblers, said first tumblers being inserted respectively into said first tumbler holes, said second tumblers being inserted respectively into said second tumbler holes, said first tumblers each having an outer tumbler section proximate to said key hole, an inner tumbler section distal from said key hole, and a stop member formed between said outer and inner tumbler sections for limiting inward movement of said outer and inner tumbler sections by a predetermined distance;

a plurality of third tumblers respectively disposed within said third tumbler holes; and a plurality of tumbler springs respectively disposed within said third tumbler holes to bias said third tumblers, respectively.

11. The tubular lock of claim 10, wherein said inner tumbler sections of said first tumblers have the same length.

12. The tubular lock of claim 11, wherein said stop member of each of said first tumblers is formed as a stop flange which has a cross-section larger than that of said inner and outer sections.

13. The tubular lock of claim 12, wherein each of said first tumbler holes has an enlarged outer section proximate to said key hole to receive said stop member and said outer tumbler section.

14. The tubular lock of claim 12, wherein said outer tumbler sections of at least two of said first tumblers have different lengths.

15. The tubular lock of claim 12, wherein at least two of said second tumblers have different lengths.

16. A combination comprising a master key, and a tubular lock, wherein said master key includes:

a key base including a key handle, a fixing seat connected to said key handle, and a sleeve connected to said fixing seat, said fixing seat having a plurality of angularly spaced apart spring holes, said sleeve having a sleeve wall projecting from said fixing seat in a direction away from said key handle;

a key tube including a large cross-section tube section, and a small cross-section tube section, said small cross-section tube section being inserted into said fixing seat and surrounded by said spring holes, said large cross-section tube section being inserted into said sleeve, said large cross-section tube section including a front end opposite to said small cross-section tube section, and a plurality of long and short grooves that are spaced apart angularly on an outer surface of said large cross-section tube section and that extend from said front end toward said small cross-section tube section, said long grooves being aligned with said spring holes, respectively, said short grooves respectively defining shoulder faces facing said front end of said large cross-section tube section;

a plurality of key springs disposed respectively within said spring holes; and a plurality of slide pieces disposed respectively and slidably within said long grooves and biased by said springs; and wherein said tubular lock includes:

a lock housing having a key hole;

a core body disposed rotatably within said lock housing proximate to said key hole and including a plurality of first and second tumbler holes which are spaced apart from each other angularly;

a fixed body fixed within said lock housing and adjacent to said core body, said fixed body including a plurality of third tumbler holes which are spaced apart angularly from each other and which are aligned with said first and second tumbler holes, respectively;

a plurality of first and second tumblers, said first tumblers being inserted respectively into said first tumbler holes, said second tumblers being inserted respectively into said second tumbler holes, said first tumblers each having an outer tumbler section proximate to said key hole, an inner tumbler section distal from said key hole, and a stop member formed between said outer and inner tumbler sections for limiting inward movement of said outer and inner tumbler sections by a predetermined distance;

a plurality of third tumblers respectively disposed within said third tumbler holes; and a plurality of tumbler springs respectively disposed within said third tumbler holes to bias said third tumblers, respectively.

* * * * *